US009126806B2

(12) United States Patent
Joyce

(10) Patent No.: US 9,126,806 B2
(45) Date of Patent: Sep. 8, 2015

(54) ELEVATOR SYSTEM WITH DISTRIBUTED DISPATCHING

(75) Inventor: Matthew Joyce, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 730 days.

(21) Appl. No.: 13/391,937

(22) PCT Filed: Nov. 10, 2009

(86) PCT No.: PCT/US2009/063776
§ 371 (c)(1),
(2), (4) Date: Feb. 23, 2012

(87) PCT Pub. No.: WO2011/059426
PCT Pub. Date: May 19, 2011

(65) Prior Publication Data

US 2012/0168257 A1 Jul. 5, 2012

(51) Int. Cl.
*B66B 1/34* (2006.01)
*B66B 1/24* (2006.01)
*B66B 3/00* (2006.01)

(52) U.S. Cl.
CPC ..... *B66B 1/2458* (2013.01); *B66B 3/00* (2013.01); *B66B 3/006* (2013.01); *B66B 2201/102* (2013.01); *B66B 2201/104* (2013.01);
(Continued)

(58) Field of Classification Search
CPC ..... B66B 1/2458; B66B 3/00; B66B 3/006; B66B 2201/102; B66B 2201/104; B66B 2201/214; B66B 2201/215; B66B 2201/4615
USPC ..... 187/247, 380–388, 391, 393, 396
See application file for complete search history.

(56) References Cited

U.S. PATENT DOCUMENTS 4,149,613 A * 4/1979 Yoneda et al. ..... 187/387
4,346,789 A * 8/1982 Ekholm ..... 187/382
(Continued)

FOREIGN PATENT DOCUMENTS

CN 101263071 A 9/2008
EP 0663366 A1 7/1995
(Continued)

OTHER PUBLICATIONS

State Intellectual Property Office of People's Republic China Supplementary Search Report for Application No. 200980162366.6 dated Jun. 5, 2014.
(Continued)

*Primary Examiner* — Anthony Salata
(74) *Attorney, Agent, or Firm* — Carlson, Gaskey & Olds

(57) ABSTRACT

An exemplary elevator input device includes a passenger interface configured to allow a passenger to place a call to indicate a desired elevator service. The elevator input device includes a controller configured to interpret any passenger input regarding desired elevator service. The controller identifies which of a plurality of elevator cars will be able to provide the desired elevator service according to a predetermined criterion. The plurality of elevator cars considered by the controller includes every elevator car that is capable of serving the call. The controller is also configured to assign the call to the identified elevator car. With the input device controller assigning the call to an identified elevator car, the dispatching of elevator cars is distributed among controllers of input devices rather than being accomplished at a single group controller.

22 Claims, 1 Drawing Sheet

(52) U.S. Cl.
CPC ..... *B66B2201/211* (2013.01); *B66B 2201/214* (2013.01); *B66B 2201/215* (2013.01); *B66B 2201/4615* (2013.01)

(56) References Cited

U.S. PATENT DOCUMENTS

| | | | | |
|---|---|---|---|---|
| 4,691,808 | A | 9/1987 | Nowak et al. | |
| 4,762,204 | A * | 8/1988 | Blain et al. | 187/247 |
| 4,766,978 | A * | 8/1988 | Blain et al. | 187/247 |
| 4,989,695 | A * | 2/1991 | Kubo | 187/247 |
| 5,427,206 | A * | 6/1995 | Powell et al. | 187/387 |
| 5,467,844 | A * | 11/1995 | Powell et al. | 187/387 |
| 5,884,729 | A * | 3/1999 | Park et al. | 187/248 |
| 5,955,708 | A | 9/1999 | Amano et al. | |
| 6,003,637 | A * | 12/1999 | Kim et al. | 187/391 |
| 6,315,082 | B2 * | 11/2001 | Hikita | 187/382 |
| 6,439,349 | B1 * | 8/2002 | Smith | 187/382 |
| 6,615,175 | B1 | 9/2003 | Gazdzinski | |
| 6,776,264 | B2 | 8/2004 | Tyni et al. | |
| 6,793,044 | B2 | 9/2004 | Koehler et al. | |
| 6,988,071 | B1 | 1/2006 | Gazdzinski | |
| 6,991,068 | B2 | 1/2006 | Siikonen et al. | |
| 7,267,202 | B2 | 9/2007 | Sirag, Jr. | |
| 7,281,610 | B2 | 10/2007 | Ylinen et al. | |
| 7,350,626 | B2 | 4/2008 | Lence et al. | |
| 7,392,883 | B2 | 7/2008 | Hikita | |
| 7,513,337 | B2 | 4/2009 | Siikonen et al. | |
| 7,841,452 | B2 | 11/2010 | Sansevero et al. | |
| 7,958,971 | B2 | 6/2011 | Mangini et al. | |
| 8,177,036 | B2 * | 5/2012 | Stanley et al. | 187/396 |
| 8,348,021 | B2 | 1/2013 | Finschi | |
| 2003/0085079 | A1 | 5/2003 | Koehler et al. | |
| 2008/0041669 | A1 | 2/2008 | Sansevero et al. | |
| 2013/0168190 | A1 * | 7/2013 | Christy et al. | 187/247 |
| 2014/0151160 | A1 * | 6/2014 | Joyce et al. | 187/388 |

FOREIGN PATENT DOCUMENTS

| | | | |
|---|---|---|---|
| EP | 0663366 | B1 | 7/1995 |
| JP | 57-117474 | | 7/1982 |
| JP | 4197969 | A | 7/1992 |
| JP | 5-201634 | | 8/1993 |
| JP | 6271234 | A | 9/1994 |
| JP | 7291548 | A | 11/1995 |

OTHER PUBLICATIONS

State Intellectual Property Office of People's Republic China Search Report for Application No. 200980162366.6 dated Sep. 25, 2013.
International Search Report and Written Opinion of the International Searching Authority for International application No. PCT/US2009/063776 mailed Aug. 11, 2010.
International Preliminary Report on Patentability for International application No. PCT/US2009/063776 dated May 24, 2012.

* cited by examiner

ELEVATOR SYSTEM WITH DISTRIBUTED DISPATCHING

BACKGROUND

Elevator systems provide a variety of types of passenger service within a variety of buildings. In smaller buildings one or two elevators may be provided to adequately address the needs for all passengers in that building. Other buildings have much larger volumes of passenger traffic on a daily basis. Such buildings typically include a large number of elevators.

Controlling all of the elevators to achieve a desired level of passenger service involves a variety of considerations. There are various known dispatching algorithms for determining which car should service a particular passenger request.

One shortcoming of known arrangements is that they require a plurality of group dispatchers, each assigned to a particular subset of the elevators within a building. Passenger requests are processed by a group dispatcher that determines which of the elevator cars within its own group can service that request. For buildings containing a large number of elevator cars, a substantial number of group dispatchers are also required. While such arrangements have proven useful, those skilled in the art are always striving to make improvements.

SUMMARY

An exemplary elevator input device includes a passenger interface configured to allow a passenger to place a call to indicate a desired elevator service. The elevator input device includes a controller configured to interpret any passenger input regarding desired elevator service. The controller identifies which of a plurality of elevator cars will be able to provide the desired elevator service according to a predetermined criterion. The plurality of elevator cars considered by the controller includes every elevator car that is capable of serving the call. The controller is also configured to assign the call to the identified elevator car.

An exemplary method of handling a passenger call requiring elevator service includes interpreting input from the passenger regarding the desired elevator service. Identifying one of a plurality of elevator cars that is able to provide the desired elevator service is done according to a predetermined criterion. The plurality of elevator cars considered for that purpose includes every elevator car that is capable of serving the call. The call is then assigned to the identified elevator car. Each of the steps is performed at an elevator input device including a passenger interface configured to allow a passenger to place a call indicating the desired elevator service.

The exemplary elevator system includes a plurality of elevator cars. A plurality of input devices allow a passenger to input a call indicating a desired elevator service. Each of the input devices includes a controller configured to interpret the passenger input regarding the desired service. Each input device controller is configured to identify which of the plurality of elevator cars is able to provide the desired elevator service according to a predetermined criteria. The controller of each input device considers every elevator car that is capable of serving the call when identifying the car to provide the service. The controller of each input device assigns the call to the identified elevator car.

The various features and advantages of a disclosed example will become apparent to those skilled in the art from the following detailed description. The drawings that accompany the detailed description can be briefly described as follows.

DETAILED DESCRIPTION

Figure 1:
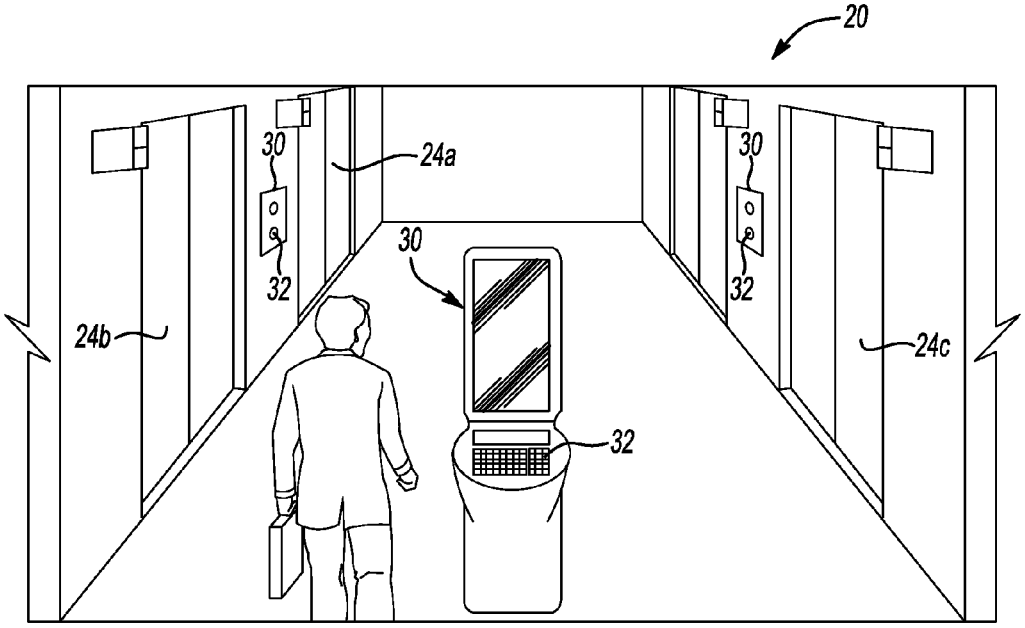
FIG. 1 diagrammatically illustrates selected portions of an elevator system designed according to an embodiment of this invention.
Figure 2:
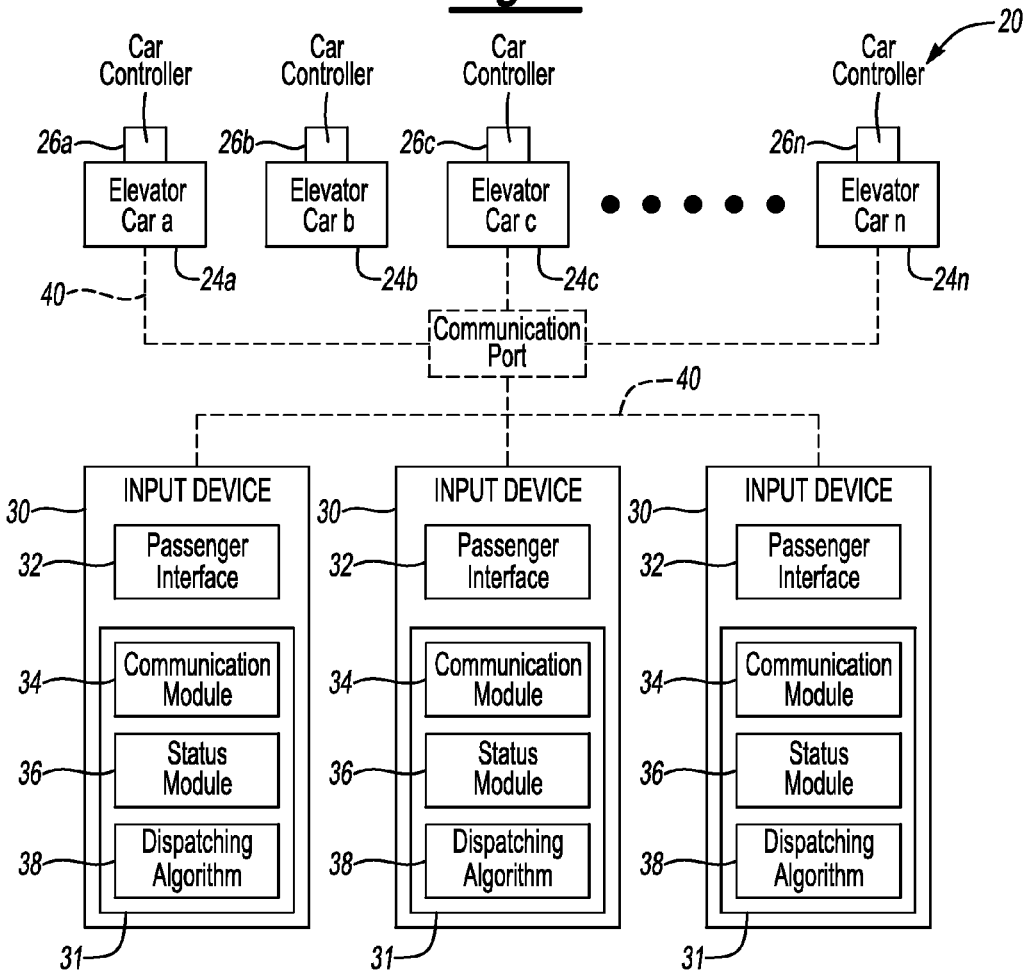
FIG. 2 schematically illustrates selected portions of an example elevator system arrangement designed according to an embodiment of this invention.

FIGS. 1 and 2 illustrate selected portions of an elevator system 20. A plurality of elevator cars 24 provide passenger service to various levels within a building. In one example, there are more than ten elevator cars in the building. Each of the elevator cars has an associated elevator car controller 26 that controls movement and position of the corresponding elevator car responsive to an instruction regarding elevator service to be provided by the corresponding car.

A plurality of input devices 30 allow passengers to place a call for elevator service. Each of the input devices 30 includes a passenger interface 32 configured to allow the passenger to place a call regarding the desired elevator service. In some examples, the passenger interface 32 allows an individual passenger to provide an indication of a destination floor at the input device (i.e., before the passenger enters any one of the elevator cars 24). In other examples, the passenger interface 32 allows an individual to indicate whether they desire to be carried in one direction or another from the floor at which the input device 30 is located. In other words, some example input devices comprise a destination entry device while others comprise a hall call button arrangement.

Each of the example input devices 30 includes a controller 31 comprising a communication module 34 that allows for each input device 30 to communicate with all other input devices and each of the elevator car controllers 26. Each input device controller 31 also includes a status module 36 that allows each input device 30 to determine the status of any one of the elevator cars 24 including, for example, the car position, current assignments for that car and a direction of travel. A dispatching algorithm 38 is provided with or as part of each input device controller 31 to allow that input device 30 to make a car assignment of a call placed at that input device 30 to achieve the desired passenger service.

Although schematically illustrated as individual modules 34, 36 and 38, the features of the communication module 34, status module 36 and dispatching algorithm 38 may be realized in one or more controllers of each input device 30. In other words, the schematic division shown in FIG. 2 is for discussion purposes. Given this description, those skilled in the art will realize what hardware, software, firmware or combination of these will best meet the needs of their particular situation for providing the functionality of the example input devices 30.

The communication module 34 facilitates communications over communication links schematically shown at 40 between each input device and each elevator car controller 26. In the example of FIG. 2, each of the input devices 30 also communicates with the other input devices 30. The communication links 40 may comprise hardwired connections within the building in which the elevator cars 24 and the input devices 30 are situated. In one example, the communication link 40 includes an Ethernet link, a CAN link or serial bus communications. The communication links 40 may also comprise wireless communication links. In another example, a combination of hardwired and wireless communication techniques are used. The communication links 40 may include one or more central ports into which each of the devices of the elevator system, are connected.

One feature of the illustrated example is that each input device 30 is able to take an elevator call and make the car assignment to service that call. In one example, the communication module 34 is configured to communicate with the passenger interface 32 for interpreting any passenger input regarding a desired elevator service request. The status module 36 contains information regarding the current status of every elevator car in the building within which the input device 30 is situated. One feature of the illustrated example is that every passenger input device 30 can potentially assign a call to any one of the entire plurality of elevator cars within the building. There is no requirement for any group control or other interface between the input devices 30 and the individual car controllers 26 for purposes of assigning a call to an elevator car and then providing the desired service.

The controllers 31 are each capable of identifying which of the elevator cars 24 should be assigned a particular passenger request received at that input device. A variety of criteria are considered in one example embodiment. The controllers 31 in one example consider how far a candidate elevator car is from the location of that input device 30 and whether there would be crowding in a particular elevator lobby. The controllers 31 also consider whether particular floors are serviced by a particular car. Such capabilities of the input devices 30 allow them to make car assignments without requiring any group controllers.

Although each example input device 30 has the ability to communicate with every elevator car controller 26 in the building it is not necessary for every input device 30 to consider every car 24 as a candidate car for a received passenger request. For example, in some buildings certain elevator cars will be situated quite far from the input device and it is not practical to assign a call to such cars because that would require the passenger to walk an undesirably long distance to the elevator car. Similarly, some cars may only have access to certain floors and they need not be considered as a candidate car for a passenger request to travel to such a floor.

In one example, at least some of the input devices 30 are preprogrammed to consider only certain of the elevator cars as candidates for potential assignment of a passenger request made at that input device. In other words, only some of the elevator cars may be considered capable of serving a call placed at a given input device 30. Some input devices 30 are programmed to always rule out certain elevator cars that are too far away from the location of that device. Some input devices 30 are programmed to recognize a certain type of call (e.g., a request to travel to a particular floor) as being one for which only certain of the elevator cars are capable of serving. This may be true, for example where an elevator car serves only certain floors in a building. Given this description, those skilled in the art will realize what criteria to use to establish a candidate pool of elevator cars that are capable of serving particular requests made at particular locations to meet their particular needs.

Based upon predetermined criteria for how to assign an elevator call (e.g., shortest waiting time, specialized passenger requirements, shortest time to arrival at the destination floor), the dispatching algorithm 38 of the input device 30 at which the passenger's call was placed selects an appropriate one of the elevator cars 24 and assigns the call to that car.

In one example, the input device 30 includes a memory containing the dispatching algorithm 38 and information gathered by the status module 36 to facilitate making the appropriate assignment and then communicating that assignment to the corresponding elevator car.

In one example, the dispatching algorithm 38 includes considering a number of calls already assigned to a candidate elevator car. In one example, the dispatching algorithm 38 also takes into account any calls received at other input devices 30 that have not yet been assigned to an elevator car for purposes of selecting a car in a manner that will not conflict with a likely assignment to be made by another one of the dispatching algorithms 38 and another input device 30.

Communications between the input devices 30 allows each controller 31 to consider any potential assignments from other input devices 30 while the controller 31 evaluates each of the candidate elevator cars 24. The communication between input devices 30 therefore allows for avoiding conflicting assignments to the same elevator car 24. For example, in some situations it is desirable to avoid having more than one input device 30 assign a passenger request to the same elevator car 24 at the same time if those requests are incompatible with each other. On the other hand, if a request received at one input device corresponds to a request at another input device (e.g., two passengers use different input devices 30 to request to be carried from the lobby floor to the $25^{th}$ floor or to floors close to each other) it may be useful to coordinate the car assignments for those requests by assigning them both to the same car 24. Of course, if one of the assignments is made before the other, the assignment will be part of the status of the elevator car and will be evaluated accordingly.

The illustrated example allows for assigning a call to any one of the elevator cars within a building. No group controller is required, which can reduce costs, and every input device has the capability of at least potentially assigning an elevator call to any one of the elevator cars within the building. In other words, each input device 30 considers every one of the elevator cars within the building for purposes of determining which of the elevator cars will be assigned a particular call.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator input device, comprising:

an input device passenger interface configured to allow a passenger to place a call to indicate a desired elevator service; and an input device controller configured to (i) interpret any passenger input regarding the call, (ii) identify which of a plurality of elevator cars would be able to provide the desired elevator service according to a predetermined criterion, wherein the plurality of elevator cars considered includes every elevator car that is capable of serving the call, and (iii) assign the call to the identified elevator car.

2. The device of claim 1, wherein the passenger interface comprises hall call buttons for indicating a desired direction of travel from a level at which the input device is located.

3. The device of claim 1, wherein the passenger interface comprises a destination entry input for indicating a desired destination floor from outside of an elevator car.

4. The device of claim 1, wherein the controller is configured to communicate with every one of the plurality of elevator cars to determine a current status of each elevator car and to provide the assigned call to the identified elevator car.

5. The device of claim 4, wherein the determined current status comprises a location and any currently assigned calls for each considered elevator car.

6. The device of claim 1, wherein the predetermined criterion comprises at least one of a minimum wait time for the passenger to board the identified elevator car, a minimum time for the desired elevator service to be complete, and a maximum number of passengers serviced in a minimum amount of time.

7. The device of claim 1, wherein the controller comprises a memory containing a dispatching algorithm for identifying the elevator car to provide the desired elevator service and assigning the call to the identified elevator car.

8. The device of claim 1, comprising a communications module configured for communicating with a plurality of elevator cars over at least one of a hardwired link or a wireless communication link.

9. A method of responding to a passenger call indicating a desired elevator service that is received at an elevator input device, comprising the steps of:

interpreting passenger input received at the elevator input device regarding the desired elevator service;

using a controller of the input device for identifying which of a plurality of elevator cars will be able to provide the desired elevator service according to a predetermined criterion, wherein the plurality of elevator cars includes every elevator car that is capable of serving the call, the identified elevator car being identified by the input device; and assigning the call to the identified elevator car, the assigning being done by the input device.

10. The method of claim 9, comprising communicating with every one of the plurality of elevator cars to determine a current status of each elevator car and to provide the assigned call to the identified elevator car.

11. The method of claim 9, wherein the predetermined criterion comprises at least one of a minimum wait time for the passenger to board the identified elevator car, a minimum time for the desired elevator service to be complete, and a maximum number of passengers serviced in a minimum amount of time.

12. The method of claim 9, comprising communicating between the input device and the plurality of elevator cars over at least one of a hardwired link or a wireless communication link.

13. An elevator system, comprising:

a plurality of elevator cars situated within a building;

a plurality of input devices, each including an input device passenger interface configured to allow a passenger to place a call to indicate a desired elevator service, and an input device controller configured to (i) interpret any passenger input regarding desired elevator service, (ii) identify which of the plurality of elevator cars will be able to provide the desired elevator service according to a predetermined criterion, the controller being configured to identify any one of the plurality of elevator cars that is capable of serving the call, and (iii) assign the call to the identified elevator car.

14. The elevator system of claim 13, wherein each input device comprises at least one of hall call buttons for indicating a desired direction of travel from a level at which the input device is located, or a destination entry input for indicating a desired destination floor from outside of any of the elevator cars.

15. The system of claim 13, wherein each controller is configured to communicate with every one of the plurality of elevator cars to determine a current status of each elevator car that is capable of serving the call and to provide the assigned call to the identified elevator car.

16. The system of claim 15, wherein the current status comprises at least a location of each elevator car and currently assigned calls for each elevator call.

17. The system of claim 13, wherein the predetermined criterion comprises at least one of a minimum wait time for the passenger to board the identified elevator car, a minimum time for the desired elevator service to be complete, and a maximum number of passengers being serviced in a minimum amount of time.

18. The system of claim 13, wherein each controller comprises a memory containing a dispatching algorithm for assigning the call to the identified elevator car.

19. The system of claim 13, comprising a communication link between each of the input devices and each of the elevator cars, wherein the communication link comprises at least one of a hardwired link or a wireless communication link.

20. The system of claim 19, wherein each of the input devices is configured to communicate with each of the elevator cars and with at least one other of the input devices.

21. The system of claim 13, wherein the input devices respectively take an elevator call and make the car assignment to service the taken call.

22. The device of claim 1, wherein the input device takes the call and makes the car assignment to service the call.

* * * * *